US009199700B2

(12) United States Patent
Fargier et al.

(10) Patent No.: US 9,199,700 B2
(45) Date of Patent: Dec. 1, 2015

(54) SEA PLATFORM HAVING EXTERNAL CONTAINERS

(75) Inventors: Cyrille Fargier, Versailles (FR); Philippe Montrocher, Versailles (FR)

(73) Assignee: Saipem S.A., Montigny le Bretonneux (FR)

( * ) Notice: Subject to any disclaimer, the term of this patent is extended or adjusted under 35 U.S.C. 154(b) by 0 days.

(21) Appl. No.: 14/345,573

(22) PCT Filed: Sep. 11, 2012

(86) PCT No.: PCT/FR2012/052028

§ 371 (c)(1),
(2), (4) Date: Mar. 18, 2014

(87) PCT Pub. No.: WO2013/041796

PCT Pub. Date: Mar. 28, 2013

(65) Prior Publication Data

US 2014/0369765 A1 Dec. 18, 2014

(30) Foreign Application Priority Data

Sep. 19, 2011 (FR) ..... 11 58311

(51) Int. Cl.

| | |
|---|---|
| ***B65B 25/08*** | (2006.01) |
| ***B63B 25/08*** | (2006.01) |
| ***B63B 25/14*** | (2006.01) |

(Continued)

(52) U.S. Cl.

CPC ..... *B63B 25/082* (2013.01); *B63B 25/14* (2013.01); *B63B 25/16* (2013.01); *B63B 35/28* (2013.01); *B63B 35/44* (2013.01); *E02B 17/00* (2013.01); *F17C 13/082* (2013.01); *F17D 1/00* (2013.01); *F17C 2221/033* (2013.01); *F17C 2223/0161* (2013.01); *F17C 2223/033* (2013.01); *F17C 2250/01* (2013.01); *F17C 2260/037* (2013.01); *F17C 2260/042* (2013.01); *F17C 2265/05* (2013.01); *F17C 2270/0105* (2013.01); *F17C 2270/0113* (2013.01); *F17C 2270/0123* (2013.01)

(58) Field of Classification Search

CPC ..... B63B 25/082; B63B 25/16; F17C 13/082
See application file for complete search history.

(56) References Cited

U.S. PATENT DOCUMENTS

| | | | | |
|---|---|---|---|---|
| 4,275,679 | A * | 6/1981 | Finsterwalder | 114/264 |
| 4,392,449 | A | 7/1983 | Dining | |

(Continued)

FOREIGN PATENT DOCUMENTS

| | | |
|---|---|---|
| DE | 870 508 | 3/1953 |
| WO | WO 01/30648 | 5/2001 |

*Primary Examiner* — Benjamin Fiorello
(74) *Attorney, Agent, or Firm* — Cozen O'Connor

(57) ABSTRACT

A support installed at sea in grounded or floating manner, the support including both a processor installation on its deck for processing a first liquid that is dangerous and/or corrosive, preferably liquefied natural gas (LNG), and also at least one tank for storing said first liquid, preferably an LNG tank incorporated within the hull of the support under the deck. The support includes at least one container situated outside the support and situated at least in part, and preferably completely, below the deck of the support on which said installation is supported, the container being fastened to the support, preferably in reversible manner, the deck including or supporting a first transfer mechanism suitable for transferring towards the container any leakage liquid flowing from at least a portion of the installation, in particular in the event of a leak.

16 Claims, 4 Drawing Sheets

(51) Int. Cl.

| | |
|---|---|
| ***F17C 13/08*** | (2006.01) |
| ***B63B 25/16*** | (2006.01) |
| ***B63B 35/28*** | (2006.01) |
| ***B63B 35/44*** | (2006.01) |
| ***E02B 17/00*** | (2006.01) |
| ***F17D 1/00*** | (2006.01) |

(56) References Cited

U.S. PATENT DOCUMENTS

| | | | | |
|---|---|---|---|---|
| 5,662,149 | A * | 9/1997 | Armellino | 141/86 |
| 2013/0084134 | A1 * | 4/2013 | Alsaffar | 405/66 |
| 2014/0263052 | A1 * | 9/2014 | Fargier et al. | 210/634 |

* cited by examiner

SEA PLATFORM HAVING EXTERNAL CONTAINERS

CROSS REFERENCE TO RELATED APPLICATIONS

This is a U.S. national stage of application No. PCT/FR2012/052028, filed on Sep. 11, 2012. Priority is claimed on France Application No. FR1158311 filed Sep. 19, 2011, the content of which is incorporated herein by reference.

BACKGROUND OF THE INVENTION

Field of the Invention

The present invention provides a support installed at sea, either in open sea, or in a protected zone such as a port, and in grounded or floating manner, i.e. either resting on, or anchored to the sea bottom, the support including both an installation on its deck for processing a liquid that is dangerous and/or corrosive, preferably liquefied natural gas (LNG), and also at least one tank for storing said liquid and incorporated within the hull of said support under said deck.

This type of support may in particular be a barge of the FPSO or FSRU type for processing and storing LNG, or it may be a ship, in particular having a hull and storage tanks made of steel or of concrete as described in WO 01/30648, and as explained below.

The methane-based natural gas is either a by-product of oil fields, being produced in small or medium quantities, in general in association with crude oil, or else it is a major product from a gas field, where it is to be found in combination with other gases, mainly C-2 to C-4 alkanes, $CO_2$, nitrogen, and traces of other gases. More generally, the natural gas comprises a majority of methane, preferably at least 85% methane, with the other main constituents being selected from nitrogen and C-2 to C-4 alkanes, i.e. ethane, propane, and butane.

When the natural gas is associated in small quantities with crude oil, it is generally processed and separated and then used on site as fuel in boilers, gas turbines, or piston engines in order to produce electricity and heat for use in the separation or production processes.

When the quantities of natural gas are large, or indeed substantial, they need to be transported so that they can be used in regions far away, in general on other continents, and in order to do this the preferred method is to transport the gas while it is in the cryogenic liquid state (−165° C.) and substantially at ambient atmospheric pressure. Specialized transport ships known as "methane tankers" possess containers of very large dimensions with extreme insulation in order to limit evaporation while traveling.

On oil fields in open sea, situated a long way off-shore, petroleum fluids such as crude oil or gas are generally recovered, processed, and stored on board a said floating support often referred to as an FPSO (floating-production-storage-offloading). Petroleum fluids such as crude oil and/or gas are then transferred to offloading ships that call regularly, e.g. every week, to recover the production from the oil field and to export it to places where it is consumed.

When transferring liquefied gas of the LNG type at −165° C., transfer devices include at least one go connection pipe for the liquefied gas and a return connection pipe, in general of smaller diameter, for removing gas from the tanks of the offloading ship progressively as they are filled with LNG, and in particular for removing methane gas so that it can be reliquefied on board the FPSO, as described below with reference to FIG. 1A.

Another technical field is one in which LNG is stored at sea close to a utilization site, e.g. in order to deliver gas to land after it has been regasified, or else to transform it on site, on-board the floating support, into electricity and for delivering said electricity to the local network on land. Under such circumstances, the ship comes to unload its cargo of LNG and the floating support is referred to as an FSRU (floating storage regasification unit), as described below with reference to FIG. 1B.

Concerning LNG, the term "processor installation" is used more particularly below to designate any installation for liquefying natural gas into LNG, any installation for regasifying LNG, and/or any installation for transferring LNG between said support and a methane tanker type ship for offloading and storing LNG, which tanker may be positioned in tandem or else drawn up alongside said support.

Processor installations of this type have means or components such as pumps, flow pipes, compressors, heat exchangers, expander devices, in general decompression turbines, cryogenic heat exchangers, and containers, and also connection pipes and connection elements between these various devices.

Leaks of the processed and stored liquid, and in particular LNG liquefied gas where applicable, may arise either from valves, pumps, heat exchangers, containers, or pipes, or else more particularly from gaskets in coupling elements or in said components, or indeed by breakage of one or more of these various components.

Leaks of LNG are particularly dangerous for three reasons:

1. Spilt LNG gasifies quickly on making contact with air and solid surfaces, and by mixing with ambient air it creates a very dangerous mixture that explodes in the presence of the slightest spark or slightest hot point.
2. Equipment conveying or containing LNG (−165° C.) is made out of material capable of withstanding such cryogenic temperatures, in general nickel-based steels or indeed Invar. Such special steels are very expensive, and in general they are not used for support elements or for the structure of the FPSO, which are generally made out of ordinary steels. However, such ordinary steels become brittle on contact with very low temperatures and they lose their mechanical strength, thus running the risk of structural elements breaking, and possibly even of the deck of the FPSO breaking in the event of a major leak directly onto said deck, unless critical locations are protected by insulating materials that are themselves very good at withstanding cryogenic temperatures.
3. Contact between LNG and seawater is very dangerous and leads to a very high risk of immediate explosion, since the cold LNG (−165° C.) is heated suddenly by seawater at a temperature in the range 10° C. to 20° C., and it is heated in the presence of air, and thus in the presence of oxygen.

SUMMARY OF THE INVENTION

The object of the present invention is to remedy the consequences associated with these problems of leaks of liquid, in particular of liquefied gas, onto the deck of such a support at sea.

To do this, the present invention provides a support installed at sea, in grounded or floating manner, the support including both a processor installation on its deck for processing a first liquid that is dangerous and/or corrosive, preferably liquefied natural gas (LNG), and also at least one tank for storing said first liquid, preferably an LNG tank incorporated within the hull of said support under said deck, the support being characterized in that it includes at least one container situated outside said support and situated at least in part, and preferably completely, below the deck of said support on which said installation is supported, said container being fastened to said support, preferably in reversible manner, said deck including or supporting first transfer means suitable for transferring towards said container any leakage liquid flowing from at least a portion of said installation, in particular in the event of a leak.

These first transfer means may comprise gutter-forming structures and possibly also pipe elements and/or liquid pumping means.

Positioning and reversibly fastening containers outside the support of the present invention presents the advantages of:

- being able to build said support in a dry dock of dimensions that are standard in terms of width or length, i.e. without requiring a dry dock of excessive dimensions, with this being advantageous since the size of a dry dock is a factor that is very limiting on the size of a support and thus also on the storage capacity of the tanks it contains; and
- being able to build said containers separately, where applicable, closer to the site at sea than said dry dock in which the support is built, and to fasten said containers on said support, either before it is towed to a site, or else on site after said support has been towed and anchored or grounded on the sea bottom; and above all
- improving safety on board said support concerning the risks of incident and/or explosion, in particular by quickly removing any leakage liquid away from said support and then emptying said container in such a manner as to return the entire installation as quickly as possible to maximum safety.

More particularly, said first transfer means for transferring leakage liquid comprise at least one collector device for collecting said leakage liquid and extending from under a said portion at least of the installation to over a first upper orifice of said container, said collector device being suitable for collecting said leakage liquid flowing from said portion of the installation and for directing it merely under gravity towards said first upper orifice of said container situated below said collector device.

It can be understood that using said first transfer means firstly avoids any contact of the leakage liquid with the deck of the support for example, and more generally with any structure of the support, and secondly avoids prolonged contact with atmospheric air.

The present invention thus advantageously consists essentially in collecting leakage flows and directing them to external containers, i.e. containers situated outside the barge and lower down, so that the flows take place naturally merely by gravity and as quickly as possible without making contact with the structure of the support and in particular with its deck, and without prolonged contact with the base of the processor installations, thereby limiting the quantity of LNG that runs the risk of vaporizing and creating an explosive gas mixture in contact with ambient air.

Still more particularly, said container is fastened in reversible manner against a side of said support.

The term "side of said support" is used herein to mean the longitudinally-extending side walls, and also the front and rear transverse walls (bow and stern).

Under such circumstances, reversible fastener means for fastening the container on the hull may be constituted merely by hooks enabling said container to be suspended from eyelets against said side. Furthermore, said first transfer means may comprise a sloping gutter or a said sloping deck sloping down from the longitudinal middle axis XX' of said deck towards the side of said support against which said container is fastened.

Specifically, and in general, the deck is itself gently sloping at 1% to 2% down towards the longitudinal side edges of the support and is suitable for allowing a liquid to flow towards a discharge outlet at and above the lateral longitudinal sides. Nevertheless, such a slope may not be sufficient for causing the flow to be fast.

Preferably, said first transfer means for transferring leakage liquid comprise a liquid collector device comprising at least one decking element fitted over said deck, said decking element comprising a sloping central plane structure preferably bordered laterally by lateral rims, the angle of inclination ($\alpha 2$) of said central plane structure of said decking element being greater than the angle of inclination ($\alpha 1$) of said deck where applicable, preferably by an angle of inclination ($\alpha 2$) lying in the range 1% to 5%, preferably in the range 2% to 4%.

When said container is fastened against the side of the support, it can be understood that said decking element presents an angle of inclination with a high point beside the decking closest to said middle longitudinal axis XX' of said support and with a low point beside the decking closest to said side.

More particularly, the support of the invention comprises:

- a plurality of elements of said decking, said decking elements together preferably covering at least the entire surface of the portion of the deck that supports a said processor installation presenting risks of LNG leaking; and
- a plurality of containers, each said decking element cooperating with at least one said container.

It can be understood that the term "decking element cooperating with a said container" is used to mean that said container is suitable for collecting said liquid flowing from said portion of the insulation situated above said decking element, said decking element directing the liquid merely under gravity towards said first upper orifice of said container situated below the bottom end of said decking element, preferably via a first transfer duct element.

A plurality of containers may thus be installed on the port and starboard walls of the hull, and where applicable, on the stern and bow walls, each of them collecting liquid coming from one or more decking elements covering a small area of the deck.

Advantageously, the walls or the surfaces of said collector device that might come into contact with said leakage liquid that it collects, in particular the top surface of the central portion of said decking, are constituted by or covered in a layer of material that withstands the cryogenic temperatures (less than or equal to −160° C.) of said leakage liquid such as LNG, in particular a composite material such as the Chartek®-Intertherm® 7050 sandwich sold by the supplier International (UK) of the AKZO-NOBEL group, and more particularly suitable for providing cryogenic thermal insulation for LNG at −165° C.

Still more particularly, said support of the invention includes attachment means suitable for fastening a plurality of said containers along its sides, and each of said containers presents a volume of no more than 300 cubic meters ($m^3$), and preferably lying in the range 50 $m^3$ to 300 $m^3$.

Containers of this volume can be built using a structure of smaller size than is needed for building the internal tanks since there is no need for a high degree of insulation, but rather a need for limited heat transfer through the wall to enable the recovered LNG to vaporize quickly but without causing the metal structure of the container or of its supports to drop below a temperature in the range −20° C. to −40° C., since that would run the risk of leading to brittle fracture of the material of said structure.

Still more particularly, said container has an elongate cylindrical shape with a vertical longitudinal axis (YY') with only a portion of said container being immersed, and in particular with a horizontal cross-section that is square or rectangular or circular.

The term "vertical axis" is used herein to mean that the axis of the container is substantially perpendicular to the horizontal longitudinal axis XX' of the support and substantially perpendicular to the level of the sea when the sea is flat.

A portion of said container remains immersed even when it is empty, and a portion of the container remains above the level of the sea even when said container is full.

The vertical elongate shape of the containers is advantageous in comparison with containers of greater horizontal size in that pumping out LNG leaves a residue of LNG at the end of pumping that is proportional to the horizontal section of said container, and thus smaller than for a container of large horizontal size. With a large horizontal size, it is advantageous for the bottom of the container to be sloping, so that the pumping device can be placed at its low point.

In a first variant embodiment, said container has a bottom constituted by the top surface of a float inside the container and of a shape that fits against the internal outline of the cylindrical side wall of said container, the bottom surface of said cylindrical side wall defining a bottom opening in such a manner that said cylindrical side wall is filled with seawater beneath said float and is suitable for moving vertically relative to said float.

It can be understood that said float always remains at the level of the surface of the water, and thus that the side wall of the container moves vertically as a function of the level of the waterline of the support, which itself is a function of the extent to which said tanks and said container(s) are filled.

This embodiment is advantageous in that it makes it possible to use a container structure that is even lighter, because the side wall does not need to withstand the hydrostatic pressure of the surrounding seawater, nor does it need to withstand the buoyancy thrust that acts on a container presenting a bottom wall that is stationary and leaktight.

In a second variant embodiment, said container includes a leaktight stationary bottom wall at the bottom end of its cylindrical side wall.

Preferably, the walls of said container are thermally insulated, and preferably insulated internally, in particular with polyurethane foam. This thermal insulation seeks to limit heat transfer due to the LNG rising in temperature, so as to keep the temperature of the steel walls of the container, and in particular the side walls situated above sea level, at a temperature that is higher than the brittle fracture temperature of said steel, and in particular a temperature that is higher than −10° C. If this is not done, said heat transfer runs the risk of cooling the steel structural elements of the container to below a temperature at which the steel presents risks of brittle fracture, i.e. a temperature below a temperature in the range −20° C. to −40° C.

Advantageously, said container comprises or co-operates with second transfer means comprising a pump and a second connection pipe suitable for transferring said leakage liquid contained in said container to a tank, preferably a said tank within the hull of said support.

In particular, said container possesses an internal pipe going down to the bottom, which pipe is connected to a pump enabling said container to be emptied and delivering the liquefied gas to a storage tank of the floating support.

Also advantageously, said container further comprises heater means for heating said liquid contained in said container, said heater means preferably being joule effect heater means, said heater means more preferably being incorporated in or against said cylindrical side wall of the container or of its thermal insulation layer.

More particularly, a heater device is a device for heating electrically or by circulating hot water or steam. In the event of the liquid phase being emptied out by pumping, said heater device is advantageously situated in the bottom portion of the container, thus making it possible after emptying to finish off complete purging of said container by vaporizing and eliminating the remaining methane gas in a flare, or merely to the open air.

When there is no device for emptying by pumping, said heater device is advantageously arranged over all or a fraction of the height of the wall of the container, and where applicable, over the bottom of said container.

More particularly, said container further comprises a second upper orifice for discharging gas, in the top portion of a side wall or in a cover-forming top wall of the container, and suitable for enabling the liquid contained in the container, once it has evaporated, to be discharged out from the container, preferably with the help of a third connection pipe, towards a burn-off flare, or towards the gas ceiling of a said tank within the hull, or to the open air.

Still more particularly, said container includes or is suitable for co-operating with a device for injecting a foaming agent, preferably via a third upper orifice in the top portion of a side wall or in a cover-forming top wall of the container. This injection of foaming agent seeks to create an inert medium inside the container when the container begins to fill with LNG. In other words, said foaming agent is injected when a leak is detected in said installation. Preferably, said containers are initially filled with an inert gas such as nitrogen.

Preferably, said support of the invention it is a floating support anchored at sea or resting on the sea bottom and supporting a unit for liquefying LNG and/or for regasifying LNG and producing electricity, said liquid being LNG.

Other characteristics and advantages of the present invention appear in the light of the following detailed description of one or more particular embodiments given with reference to the following figures, in which:

DETAILED DESCRIPTION OF THE PRESENTLY PREFERRED EMBODIMENTS

Figure 1A:
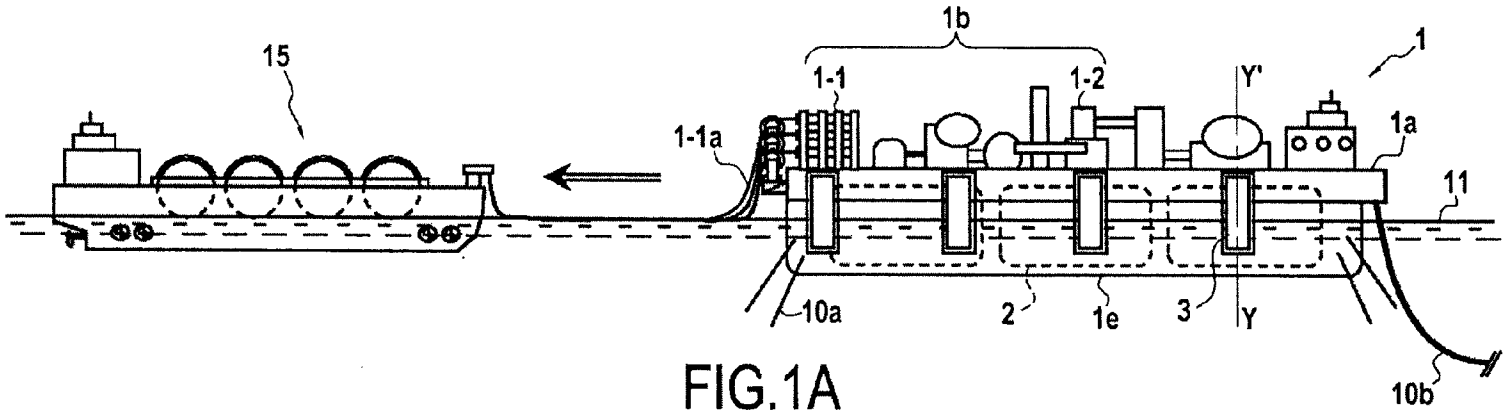
FIG. 1A is a side view of an FPSO type floating support supporting a processor unit 1*b* on a deck 1*a*, said processor unit 1*b* comprising LNG liquefaction equipment 1-2 and means for transferring LNG between said floating support 1 and an offloading ship 15.

In FIG. 1A, the FPSO type floating support 1 is anchored to the sea bottom 12 by anchor lines 10*a*. It receives natural gas extracted from wells in the sea bottom via production pipes 10*b* connecting the bottom to the surface. It includes storage tanks 2 for storing LNG 2*a*, and also transfer pipes 1-1*a*, here shown offloading towards a ship of the methane tanker type, referred to herein as an offloading ship 15, and shown in a so-called "tandem" configuration. Said FPSO 1 possesses equipment 1-2 for processing and liquefying natural gas, and tanks 2 for storing LNG incorporated within its hull 1*e*. Said FPSO is fitted with a device 1-1 for storing and guiding a flexible transfer hose 1-1*a* for offloading LNG to the offloading ship 15.

Figure 1B:
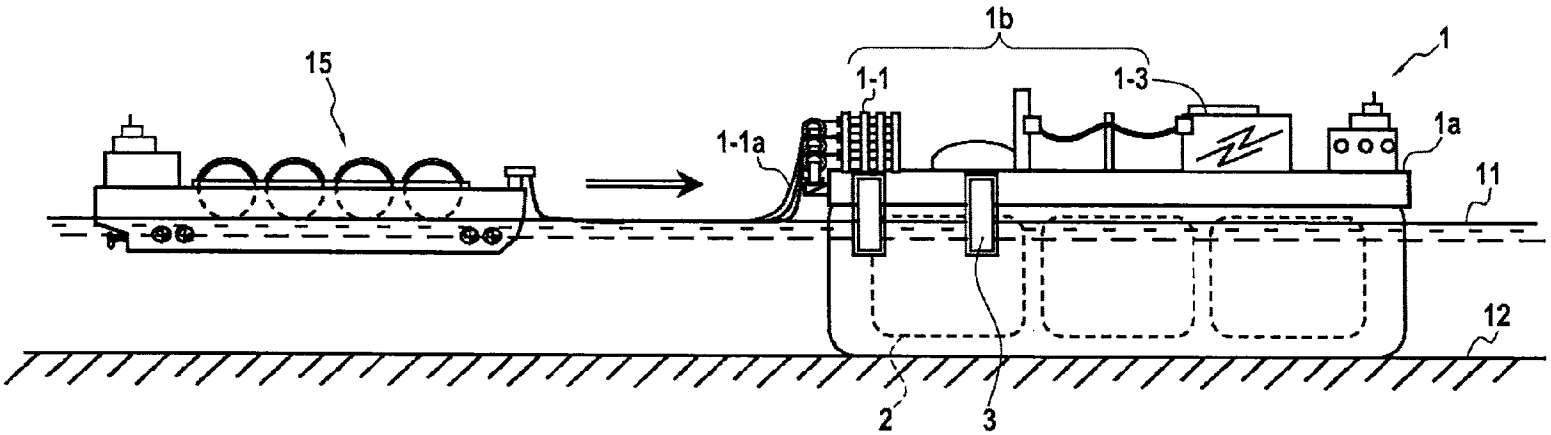
FIG. 1B is a side view of an FSRU type support resting on the sea bottom 12, the support including a processor unit 1*b* on its deck 1*a*, said processor unit having regasification and electricity production equipment 1-3 and means 1-1 for transferring LNG to an offloading ship 15.
Figure 2:
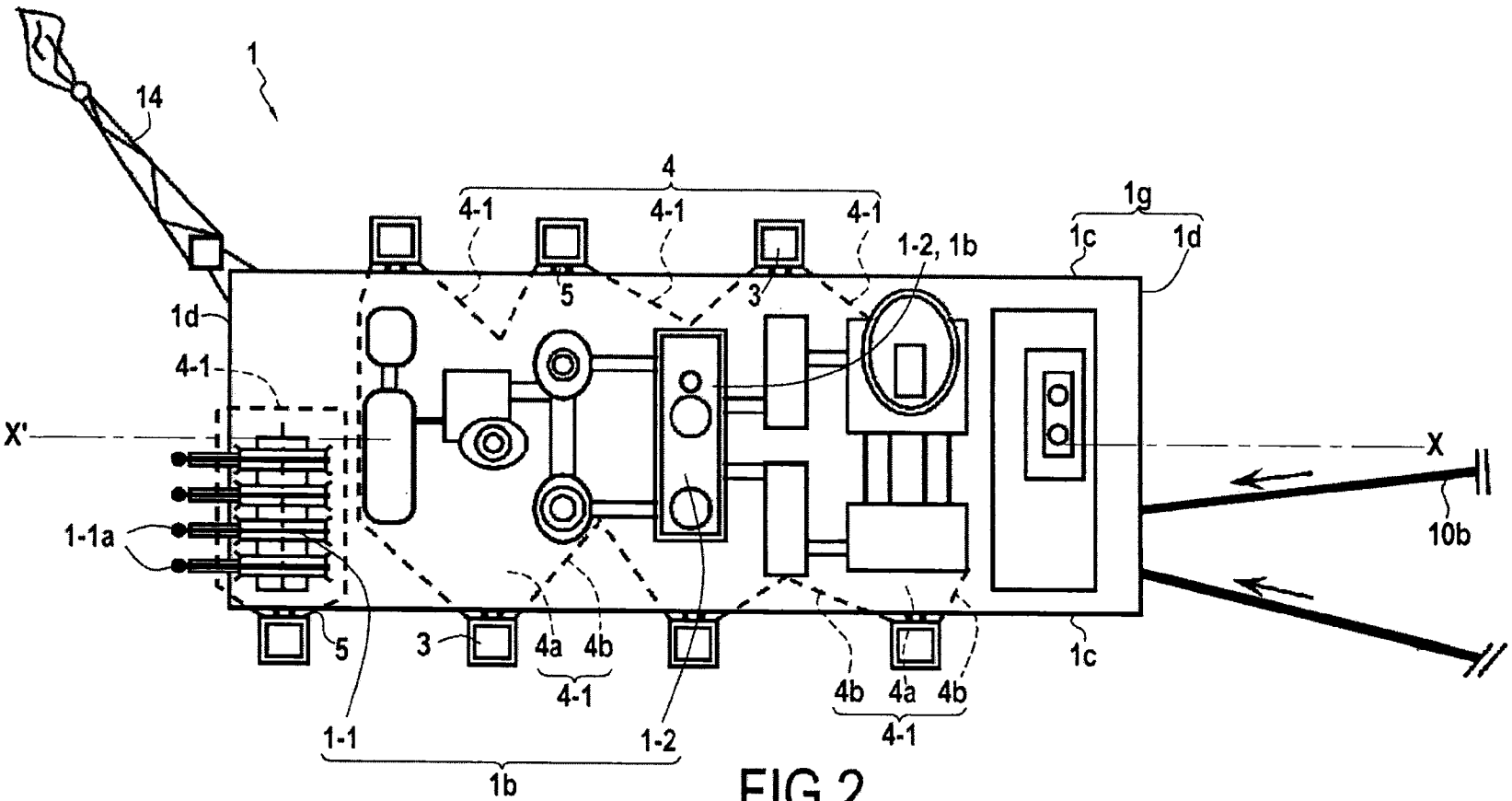
FIG. 2 is a plan view of the FIG. 1 FPSO type floating support.

FIGS. 1 and 2 show and FPSO type floating support having four cylindrical containers 3 on a first side 1*c* of the hull 1*e*, each container having a vertical axis YY' and a horizontal cross-section that is square, and each being attached in reversible manner by respective reversible attachment means 5 arranged against each said side 1*c*. Three containers 3 on each side 1*c* receive leakage liquid 2*a*' coming from the processor installation 1*b* resting on the deck 1*a* of the floating support. More precisely, each of these six containers 3 receives leakage liquid 2*a*' collected from a decking element 4-1 collecting the leakage liquid coming from a portion of said installation 1*b*. In this example, the portion of the deck 1*a* supporting the liquefaction unit 1-2 is thus covered by a set of six decking elements 4-1 covering all of said portion of the surface of the deck that might receive leakage liquid coming from said liquefaction unit 1-2, with three decking elements 4-1 pouring the liquid towards each of said opposite sides 1*c* in such a manner as to be capable of pouring the leakage liquid 2*a*' into a respective container 3 for each decking element 4-1. A seventh decking element 4-1 covers the rear portion of the surface of the deck 1*a* supporting the device 1-1 for storing and guiding the transfer pipe 1-1*a* arranged close to the rear wall 1*d* of the hull 1*g*, suitable for pouring the leakage liquid coming from the installation 1-1 towards one of the sides 1*c* fitted with a fourth container of similar shape.

In FIG. 1B, the support 1 of the FSRU type rests on the sea bottom 12. It includes an installation 1*b* comprising a unit 1-3 for regasifying LNG and for producing electricity, the unit including a transformer station for delivering electricity to land. The support 1 includes LNG storage tanks 2. In this example they are shown being loaded from a methane tanker type ship 15, referred to herein as a supply ship, that is in a so-called "tandem" configuration, said support 1 also being fitted with a device 1-1 for storing and guiding a flexible transfer pipe 1-1*a* for loading LNG from a supply ship 15.

In FIGS. 1A and 1B, the support 1 has three storage tanks 2 of substantially rectangular parallelepiped shape that are arranged side-by-side in succession in the longitudinal direction XX' extending along the entire width of the floating support inside its hull 1*e* in the transverse direction that is horizontally perpendicular to the direction XX'

Figure 3:
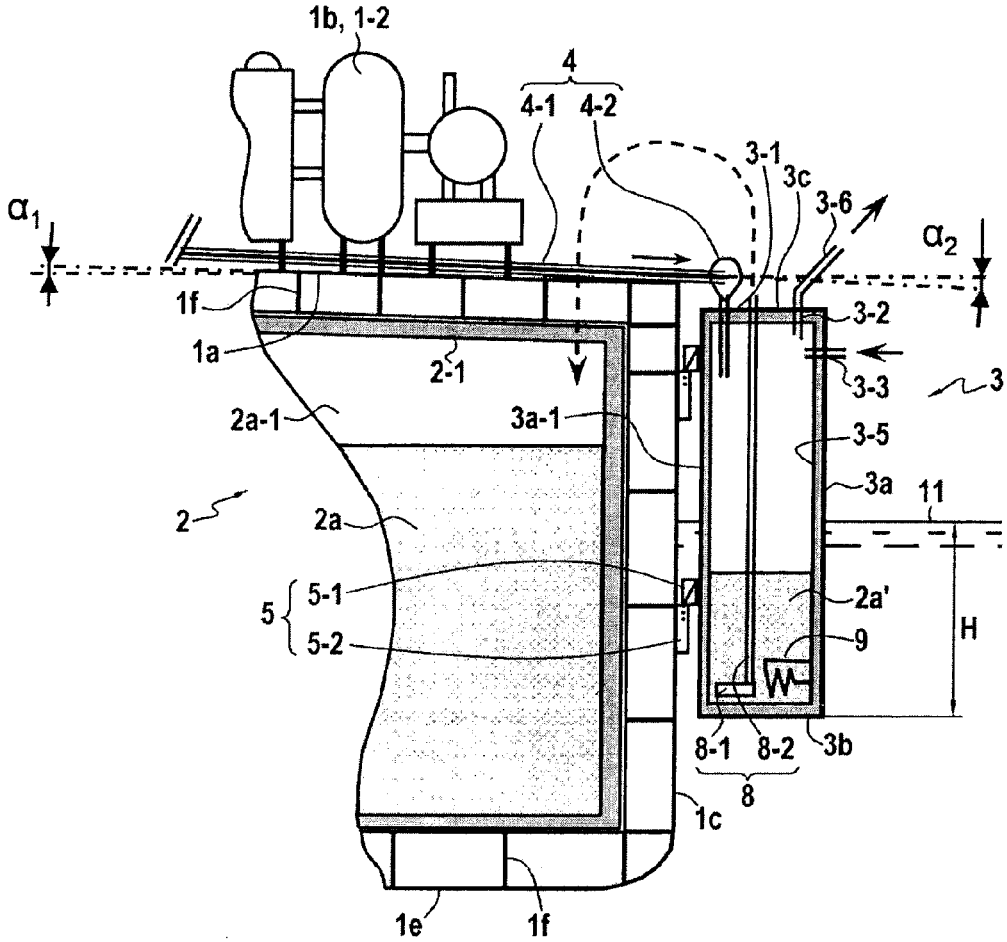
FIG. 3 is a cross-section view in a vertical plane perpendicular to the longitudinal direction XX' of said floating support through decking 4-1 and a container 3 of the present invention, said container in a first variant having a solid bottom 3*b* that is closed in leaktight manner.

In FIG. 3, the steel walls of the tanks 2 are covered in an internal thermally insulating layer 2*a*-1 constituted by polyurethane foam and by a thin internal membrane of stainless steel in contact with the LNG and capable of withstanding cryogenic temperatures, such that the tanks may be considered as being cryogenic tanks suitable for maintaining the LNG 2*a* that they contain in the liquid state. Likewise, the external containers 3 present walls of steel fitted on their inside faces with the same thermally insulating material 3-5 so that said containers may also be considered as cryogenic containers suitable for containing LNG in the liquid state at −165° C. while nevertheless having a much lower degree of insulation, so as to encourage the LNG to evaporate and nevertheless avoiding the structural elements of said containers reaching temperatures lower than a temperature in the range −20° C. to −40° C., so as to avoid any brittle fractures in said structural elements. Thus, in this figure, the bottom portion of the container (its walls and its bottom) that is permanently in contact with seawater may present a low level of insulation, since there is no risk of the temperature of the bottom structure dropping below −20° C., because of its direct and permanent contact with seawater at a temperature in the range 10° C. to 20° C. In contrast, the top portion that emerges permanently or temporarily (due to variations in draft as a function of loading) is in contact with ambient air that is likewise at a temperature in the range 10° C. to 20° C. Because less heat is exchanged with air than when making contact with seawater, it is appropriate to have a higher performance insulation system so that heat exchange through said insulation system does not lead to structural elements being cooled to such an extent that their temperature drops below a temperature in the range −20° C. to −40° C., thereby avoiding brittle fractures of the steel wall of said structures.

The outer side walls 1*c* and 1*d*, and also the bottom wall 1*e* and the deck 1*a* defining the hull 1*g* constitute the "hull girder", i.e. the overall strong structure 1*f* of the floating support.

In FIG. 3, the plane of the deck 1*a* is shown as being inclined with a downward slope from the horizontal middle axis XX' of the support and of the deck towards the sides 1*c* constituting the longitudinal side walls of the hull at an angle $\alpha 1$ of about 1°. The top wall or cover 3*c* of the containers is a little below the top ends of the sides 1*c*. The vertical cylindrical side walls 3*a* of the containers 3 present respective side faces 3*a*-1 each having two hooks 5-1 arranged in a high portion and in a low portion and suitable for being suspended from sockets 5-2, i.e. parts presenting respective hollow shapes complementary to said hooks or "hinge pins", that are applied against the outside faces of said sides 1*c* in such a manner that said containers can be suspended therefrom and thus attached reversibly when the hooks 5-1 co-operate with said parts 5-2. Collecting and transferring the leakage liquid 2*a*' from the processor installation 1*b* towards the inside of the container 3 takes place with the help of a collector device constituted by a plurality of decking elements 4-1. Each decking element 4-1 comprises a carrier structure 4*a* made of steel or of duck board and covered in a layer of strong and insulating composite material 4*a*-1, e.g. a sandwich made of Chartek®-Intertherm® 7050 from the supplier International (UK) of the AKZO-NOBEL group. The central portion 4*a*-1 is inclined at an angle $\alpha 2$ corresponding to a slope lying in the range 1% to 5%, and preferably in the range 2% to 4% relative to the horizontal. It is fastened on top of the deck 1*a* with a downward slope from the end of the decking closest to the longitudinal middle axis XX' towards the low end of the decking extending beyond the side 1*c*, i.e. outwards from the floating support 1 above a first upper opening 3-1 through the cover 3*c* of the container 3. The leakage liquid flowing over the decking 4-1 at its lower end towards said first opening 3-1 of the container is channeled with the help of a device 4-2 having a small upper chamber 4-2*a* and a lower pipe element 4-2*b* enabling the leakage liquid 2*a*' to flow into the inside of the container 3.

The containers 3 are advantageously installed on the hull 1*g* after the hull has been floated in a shipyard, but before it has been towed to site at sea. In the event of towing taking place over very long distances, such as several thousands of kilometers, they may advantageously be installed only after reaching the site, and they may be fabricated in a shipyard closer to the site.

In the plan view shown in FIG. 2 each decking element co-operating with at least one container 3 presents a trapezoidal shape with its side rims 4*b* tapering towards the portion 4-2 of the device for collecting and transferring liquid to the container 3. It can be understood that the rims 4*b* seek to prevent leakage liquid from leaving the central portion of the decking 4*a* and to channel the flow of leakage liquid towards the container 3 by the tapering width of the central portion 4*a* towards the side.

Figure 4:
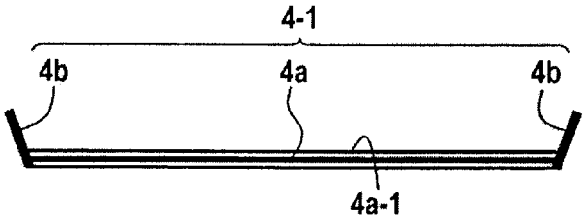
FIG. 4 is a section view on AA of a decking element 4-1 of FIG. 3A.
Figure 3A:
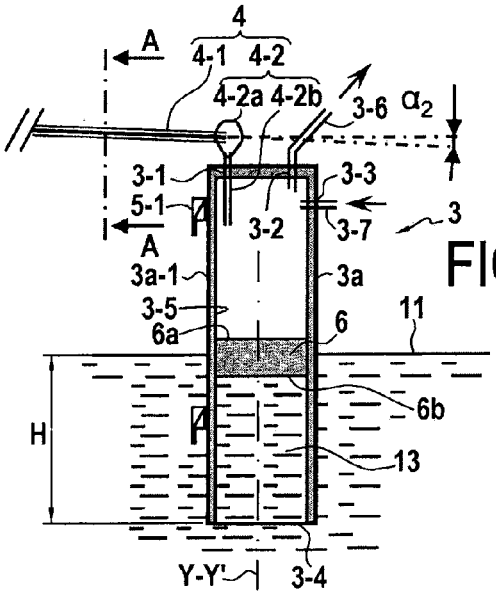
FIGS. 3A, 3B, and 3C show a second variant embodiment of a container of the invention having a bottom opening 3-4 and an internal float 6 having a top surface 6*a* defining a variable inside volume of said container.

In FIG. 4 there can be seen a section view on plane AA of FIG. 3A showing a decking element 4-1 comprising a steel support structure 4*a*, strong and insulating composite material 4*a*-1, and raised edges 4*b* for channeling the LNG towards the container situated below.

The decking elements 4-1 thus constitute gutters collecting and channeling the liquid leaking from the processor installation 1*d* towards and up to the top orifices 3-1 of the containers 3.

Once the leak(s) is/are under control, the containers 3 are full of leakage liquid 2*a*' at various levels, and it is then desired to empty them as quickly as possible in order to return the entire installation to a maximum level of safety. Several variants are possible. In a first variant embodiment, second transfer means 8 are used that comprise a pump 8-1 serving to cause the leakage liquid 2*a*' to flow inside a second connection pipe 8-2 extending from close to the bottom 3*b* of the container up to and through the cover 3*c* and extending beyond that, e.g. towards and into the gas ceiling 2*a*-1 of an LNG storage tank 2.

In a second variant embodiment, the liquid 2*a*' is regasified, if necessary, with the help of a heater device 9 that may be immersed in the leakage liquid 2*a*' inside the container 3, or that may be incorporated against the side wall of the container 3, and/or in or against the internal thermal insulation layer 3-5 of the container 3. Once regasified, the LNG 2*a*' may be discharged through a third pipe element 3-6 passing through a second upper opening 3-2 of the cover 3*c* of the container 3. The third pipe element 3-6 thus enables the gas to be discharged, either merely into the atmosphere, or else by means of pipes (not shown) to a burn-off flare 14 installed at one end of the floating support, as shown in FIG. 2. Even when a heater device 9 is not used, the second opening 3-2 and the second pipe element 3-6 make it possible to discharge the gas either to the open air or else to the flare, as explained above.

In the embodiment of FIG. 3, the container 3 has a portion that always remains immersed, representing a fraction of the height H of the container 3 starting from its bottom 3*b* that lies in the range ¼ to ¾, and more particularly in the range ⅓ to ½ of the height H of the container 3 from its bottom 3*b*, i.e. below the sea surface 11. It can be understood that the height H varies as a function of the level of the waterline of the hull, which in turn varies depending on whether the tanks 2 are empty (waterline at about ¾ of the height of the container above its bottom wall 3*b*) or the tanks 2 are full of liquid 2*a* (waterline at about ¾ of the height of the container below its top wall 3*c*, or about ¾ above its bottom wall 3*b*). In this embodiment, buoyancy acts on the entire immersed volume of the container, and in addition the structure of said container must be capable of withstanding pressure, more particularly in its bottom portion. Thus, the attachment points need to withstand forces that are directed mainly downwards when the container is full of leakage liquid and when the FPSO is partially or completely empty, and to forces that are directed upwards when the container is empty and the FPSO is completely full.

Figure 3B:
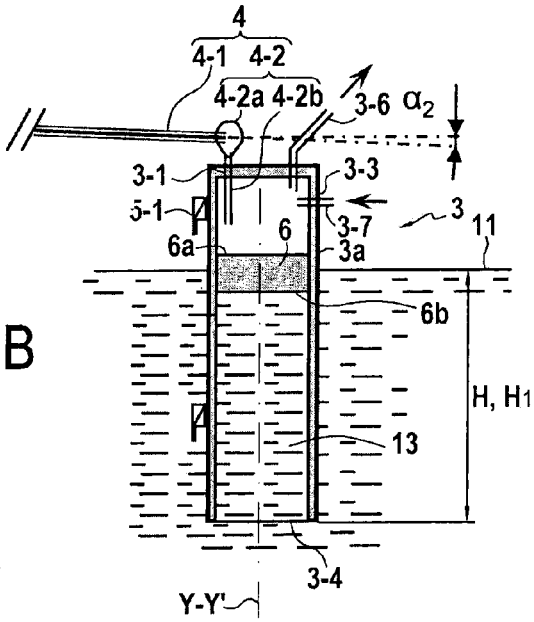
Figure 3C:
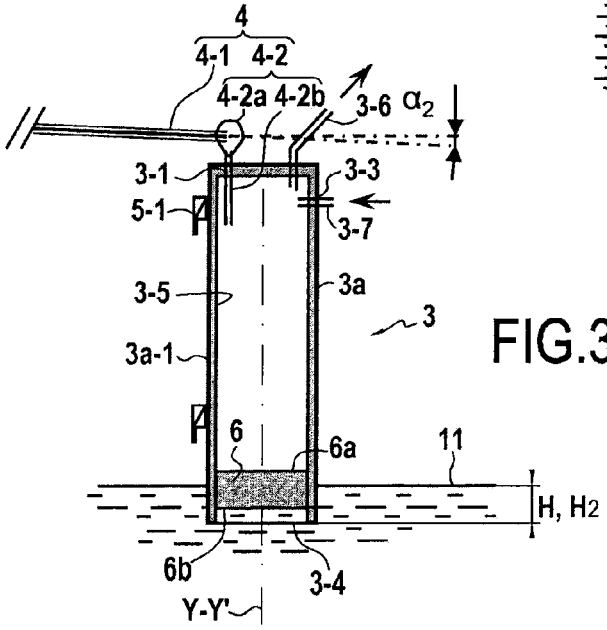

In FIGS. 3A, 3B, and 3C, there can be seen a second embodiment of the container 3 in which the bottom end of the cylindrical side wall 3*a* defines a bottom opening 3-4 of the container. In this second embodiment, the container 3 contains a float 6 having a top surface 6*a* that defines the bottom surface of the container, it nevertheless being understood that the float 6 presents a shape, in particular a substantially rectangular block shape, and an outline, in particular of substantially square section, that matches the shape of the inside surface of the cylindrical side wall 3*a* so as to allow the reservoir at 3 to slide vertically relative to the float 6, which float presents buoyancy so as to remain continuously substantially level with the top surface 11 of the sea. Thus, the height H of the immersed portion of the container 3 varies as a function of the height of the waterline of the floating support between a maximum value $H_1$ corresponding to an FPSO in which the tanks are full (FIG. 3B), and a minimum height $H_2$ corresponding to an FPSO in which the tanks are empty (FIG. 3C). The portion of the container between the undersurface 6*b* of the float 6 and the bottom opening 3-4 of the container 3 is filled with a varying height of seawater 13. This second embodiment presents the advantage that the empty volume of the container, if any, is always situated below the level 11 of the sea, such that the structure of the side walls of the container can present strength that is relatively weak, since there is no need to withstand the hydrostatic pressure of seawater, unlike the first embodiment of FIG. 3 in which it can happen that a portion of the empty inside volume of the container 3 is immersed and needs to withstand hydrostatic pressure. Likewise, forces on the fastener elements no longer change direction as a function of the extent to which the FPSO is full, and it can be considered that the forces in the structure of the container and in its supports are substantially constant. In practice, regardless of the shape of the inside horizontal cross-section of the container, the outline of the float corresponds to said shape of the inside section of the container, it being understood that clearance, and preferably regular clearance, e.g. of a few centimeters, exists between said float and said inside wall of said container around the entire periphery of said float.

The drawback of this second embodiment of FIGS. 3A to 3C is that, where applicable, the available fraction of the inside volume of the container 3 tends to decrease as the storage tanks 2 are emptied. Under such circumstances, using second transfer means 8 or discharge means 3-6 is more particularly advantageous.

The float 6 is advantageously made in conventional manner out of syntactic foams, given their high level of mechanical strength and their excellent behavior at cryogenic temperatures (−165° C.)

Because LNG presents a negative temperature at around −165° C., when it drops on the top surface 6*a* of the float, the ring of seawater situated between the periphery of the float 6 and the wall of the container freezes almost immediately and transforms into ice, thereby blocking said float 6 against the cylindrical side wall 3*a* of the container and as a result sealing at the bottom of the container, thereby preventing said float from moving down below the level 11 of the sea under the effect of the weight of leakage liquid 2*a*' that it is carrying.

Also advantageously, the containers 3 are provided with a third opening 3-3 in the top portions of their cylindrical side walls 3*a* so as to enable an inert foaming agent to be inserted into the inside of the container by means of a pipe element 3-7, the foaming agent coming from a foam generator (not shown). Thus, in the event of a leakage in the installation 1*b*, as soon as the container begins to fill, the foam generator is activated so as to confine the LNG and limit any introduction of air, given that oxygen in the air runs the risk of explosion or fire when mixed with natural gas. The presence of this foam does not in any way hinder the vaporization of the LNG, nor does it hinder the evacuation of gas to the outside of the container, as described above. Suitable foaming agents are foams of the firefighting type known to the person skilled in the art and sold by the supplier ANGUS FIRE (UK).

It can be understood that said first, second, and third openings 3-1, 3-2, and 3-3 are advantageously fitted with devices enabling them to be closed at will, such as valves.

The above described devices for transferring and collecting leakage liquids 2*a*' make it possible to collect the leakage liquid 2*a*' and to eliminate it quickly, where elimination may take place in controlled manner at will through the various above described transfer and discharge means in the form of a liquid or of a gas so as to avoid any risk of explosion or fire, and so as to enable the installations to be returned as quickly as possible to a configuration of maximum safety.

The volume of each of said containers is determined as a function of the volumes of LNG applicable to the areas covered by the collector devices connected to said container. Consideration is thus taken of the following:

- firstly the volumes of the vessels concerned (pipework, containers, pumps, . . . ) situated between the upstream and downstream valves; and
- secondly the production volume that is current during a period of time corresponding to the beginning of a leak incident and effective closure of all of the upstream and downstream valves involved, i.e. in general several minutes.

Thus, the volume of each of the containers is a function of its location relative to the installation, and may vary over a wide range, e.g. 50 $m^3$ to 300 $m^3$.

The description above relates to containers presenting respective covers on top through which there pass pipes for delivering LNG or foam, and also pipes for discharging gas; however, in a simplified version, said containers need not have covers. Under such circumstances, as soon as a leak occurs, it is essential to fill said containers with foam so as to confine the LNG, with the LNG then evaporating directly to the open air through the thickness of a layer of said foam.

The invention claimed is:

1. A support installed at sea in a grounded or a floating manner, the support having a deck and including a processor installation for processing a first liquid, and at least one tank for storing said first liquid, the support comprising: at least one container situated outside said support and at least in part below the deck of said support on which said installation is supported, said container being fastened to said support, said deck including or supporting a first transfer means suitable for transferring towards said container any leakage liquid flowing from at least a portion of said installation.

2. The support according to claim 1, wherein said first transfer means for transferring leakage liquid comprise at least one collector device for collecting said leakage liquid and extending from under at least a portion of the installation to over a first upper orifice of said container, said collector device being suitable for collecting said leakage liquid flowing from said portion of the installation and for directing said leakage liquid merely under gravity towards said first upper orifice of said container situated below said collector device.

3. The support according to claim 2, wherein the walls or the surfaces of said collector device that might come into contact with said leakage liquid that is collected are constituted by or respectively covered in a layer of material that withstands cryogenic temperatures.

4. The support according to claim 1, wherein said container is fastened in reversible manner against a side of said support.

5. The support according to claim 1, wherein said first transfer means for transferring leakage liquid comprise a liquid collector device comprising at least one decking element fitted over said deck, said decking element comprising a sloping central plane structure, an angle of inclination ($\alpha 2$) of said central plane portion of said decking element being greater than an angle of inclination ($\alpha 1$) of said deck.

6. The support according to claim 5, comprising:

a plurality of elements of said decking, said decking elements together covering at least the entire surface of the portion of the deck that supports said processor installation; and a plurality of containers, each said decking element co-operating with one of said containers.

7. The support according to claim 1, comprising an attachment which fastens a plurality of said containers along its sides, said containers having a volume of no more than 300 m3.

8. The support according to claim 1, wherein said container has an elongate cylindrical shape with a vertical longitudinal axis with only a portion of said container being immersed.

9. The support according to claim 1, wherein said container has a bottom constituted by the top surface of a float inside the container and of a shape that fits against the internal outline of the cylindrical side wall of said container, the bottom surface of said cylindrical side wall defining a bottom opening in such a manner that said cylindrical side wall is filled with seawater beneath said float and is suitable for moving vertically relative to said float.

10. The support according to claim 1, wherein said container includes a cylindrical side wall and a leaktight stationary bottom wall at the bottom end of the cylindrical side wall.

11. The support according to claim 1, wherein the walls of said container are thermally insulated.

12. The support according to claim 1, wherein said container comprises or co-operates with a second transfer means comprising a pump and a second connection pipe suitable for transferring said leakage liquid contained in said container to a tank.

13. The support according claim 1, wherein said container further comprises a heater for heating said liquid contained in said container.

14. The support according to claim 1, wherein said container further comprises a second upper orifice for discharging gas, in the top portion of a side wall or in a cover-forming top wall of the container, and suitable for enabling the liquid contained in the container, once the liquid has evaporated, to be discharged out from the container.

15. The support according to claim 1, wherein said container includes or is suitable for co-operating with a device for injecting a foaming agent.

16. The support according to claim 1, wherein the support is a floating support anchored at sea or resting on the sea bottom and supporting a unit for liquefying LNG and/or for regasifying LNG and producing electricity, said liquid being LNG.

* * * * *